United States Patent [19]

Fidler

[11] Patent Number: 5,070,761

[45] Date of Patent: Dec. 10, 1991

[54] VENTING APPARATUS FOR CONTROLLING MISSILE UNDERWATER TRAJECTORY

[75] Inventor: John E. Fidler, Los Gatos, Calif.

[73] Assignee: The United States of America as represented by the Secretary of the Navy, Washington, D.C.

[21] Appl. No.: 567,880

[22] Filed: Aug. 7, 1990

[51] Int. Cl.[5] ..... F41F 3/07; F41G 9/00; F42B 10/00

[52] U.S. Cl. ..... 89/1.809; 244/3.22

[58] Field of Search ..... 89/1.809, 1.810; 114/20.1, 21.1, 23, 238; 244/3.22

[56] References Cited

U.S. PATENT DOCUMENTS

| | | | |
|---|---|---|---|
| 3,034,434 | 5/1962 | Swaim et al. | 244/3.22 |
| 3,096,739 | 7/1963 | Smith | 114/23 |
| 3,513,750 | 5/1970 | Penza | 89/1.809 |
| 3,540,679 | 11/1970 | McCollough et al. | 244/3.22 |
| 3,604,661 | 9/1971 | Mayer, Jr. | 244/207 |
| 3,892,194 | 7/1975 | Goedde et al. | 89/1.809 |
| 3,977,629 | 8/1976 | Tubeuf | 244/3.22 |
| 4,211,378 | 7/1980 | Crepin | 244/3.22 |
| 4,463,921 | 8/1984 | Metz | 244/3.22 |
| 4,531,693 | 7/1985 | Raynaud et al. | 244/3.22 |
| 4,674,707 | 6/1987 | Kranz | 244/3.22 |
| 4,681,283 | 7/1987 | Kranz | 244/3.22 |
| 4,712,748 | 12/1987 | Schäfer | 244/3.22 |
| 4,928,906 | 5/1990 | Sturm | 244/3.22 |

FOREIGN PATENT DOCUMENTS 3442973 1/1986 Fed. Rep. of Germany .

*Primary Examiner*—David H. Brown

*Attorney, Agent, or Firm*—Wayne O. Hadland; Kenneth L. Warsh; Robert Wohlfarth

[57] ABSTRACT

Apparatus for controlling the underwater course of a submarine-launched missile, by which gas contained within the missile body is vented from the interior of the missile, through ports in the missile exterior, into the water to alter the water pressure distribution over a portion of the exterior surface, thereby producing a desired pitching moment and resulting missile movement.

4 Claims, 5 Drawing Sheets

VENTING APPARATUS FOR CONTROLLING MISSILE UNDERWATER TRAJECTORY

BACKGROUND

1. Field of the Invention

This invention relates in general to underwater launching of missiles from submarines, and more particularly but without limitation thereto to apparatus for controlling the underwater trajectory of missiles by selectively venting gas from the missile interior out to regions in the water flowing over the missile exterior that would otherwise be at a lower pressure.

2. Information

A commonly used technique for launching a missile from a submerged submarine involves admitting pressurized gas into the submarine launch tube containing the missile sufficiently to both overcome the static water pressure head and propel the missile upward with such an initial velocity as to cause the missile to breach the water surface and travel beyond up into the atmosphere, after which the primary rocket motor ignites.

If the rocket motor of the ejected missile does not ignite, there is a risk that the missile will strike the submarine as it falls back into the water.

If a missile is launched from a moving submarine, the relative motion between the submarine and the water (crossflow) causes hydrodynamic forces to be exerted on the missile, causing it to pitch backwards as it emerges from the launch tube and risk striking the wall of the launch tube. Consequently, launch tubes may be provided with resilient linings which allow missile contact in order to exert forces for counteracting the hydrodynamically induced forces; however the missile structure must be made stronger and heavier in order to withstand such contact forces. Alternatively, the launch tubes may be made large enough to accommodate the missile sideways movement, but this can result in excessively large tubes and insufficient control of missile attitude.

Consequently a long-felt need exists for a way to exert side forces and/or moments on an underwater-launched missile both as it emerges from the submarine launch tube and during the underwater course of travel from the launch tube to the surface. The present invention is directed toward reducing the foregoing risks and satisfying the need, using apparatus to selectively vent gas from within the missile interior out to low pressure regions in the water flowing over the missile exterior.

OBJECTS, FEATURES, AND ADVANTAGES

It is an object of this invention to control the underwater trajectory of a submarine-launched missile.

Another object of this invention is to counteract hydrodynamic forces acting on a submarine-launched missile caused by the relative motion between the submarine and the water (crossflow).

A further object of this invention is to avoid damaging a submarine in the event of missile fallback caused by non-ignition of the rocket motor.

It is a feature of this invention to control the venting of pressurized gas (e.g., air) that would otherwise escape in an uncontrolled manner from interior voids within a missile as it travels from submerged depths to the water surface.

It is a further feature of this invention to selectively direct the gas venting from within the missile interior out into regions in the water flowing over the missile exterior that would otherwise be at lower pressure if the gas were not vented into these regions.

It is an advantage of this invention that the distribution of lateral forces acting on a missile during underwater travel is altered by the venting of gas into selected areas that would otherwise be at lower pressures.

It is a further advantage of this invention that additional energy is not required for its operation.

SUMMARY OF THE INVENTION

Accordingly, the present invention relates to apparatus for actively controlling the venting of gas from the interior of a missile in such a manner as to influence the trajectory of the missile during the course of underwater travel.

When a missile is ejected from a submarine launch tube, gas vents from cavities within the interior of the missile through openings in the missile structure out into the water as the missile travels from deep water to the surface (as a consequence of the gas expanding due to the decreasing surrounding water pressure). Typically this gas venting is studied and its effect on missile motion is analyzed during underwater testing for possible harmful effects; this invention utilizes the venting gases for controlled beneficial effects.

While a missile is traveling underwater, the pressure that the water exerts on the exterior surface of the missile varies over the path from the nose tip to the bottom end of the cylindrical main body. Where the water flows in a path that is concave adjacent to the missile surface (such as at a point mid-way between the tip of the nose and the junction between the nose and the cylindrical body), there will exist a lower localized pressure than in a region where the flow is straight (such as along the cylindrical body sides) or convex (such as near the tip of the nose). The present invention exploits this naturally occurring non-uniform pressure distribution by directing venting gas into selected regions that would otherwise be at low pressure, hence altering the pressure distribution over a portion of the surface of the missile so as to influence the trajectory of the missile.

The vented gas produces a layer of gas extending down the length of the missile. This layer permits the higher pressure near the aft end of the cylindrical portion of the body to be transmitted upward to the lower pressure region of the nose. It should be clearly understood and emphasized that this technique of altering the water pressure distribution by admitting vented gas into the flow of water in what would otherwise be local regions of low pressure is materially different than using the reaction forces of gas jets to control missile attitude.

The attendant advantages will be readily appreciated as the present invention becomes better understood as described in detail with reference to the accompanying drawings.

DESCRIPTION OF THE PREFERRED AND OTHER EMBODIMENTS

Theory of Operation

Before proceeding with a detailed description of the apparatus, an overview of the theory of operation will be provided.

Figure 8:
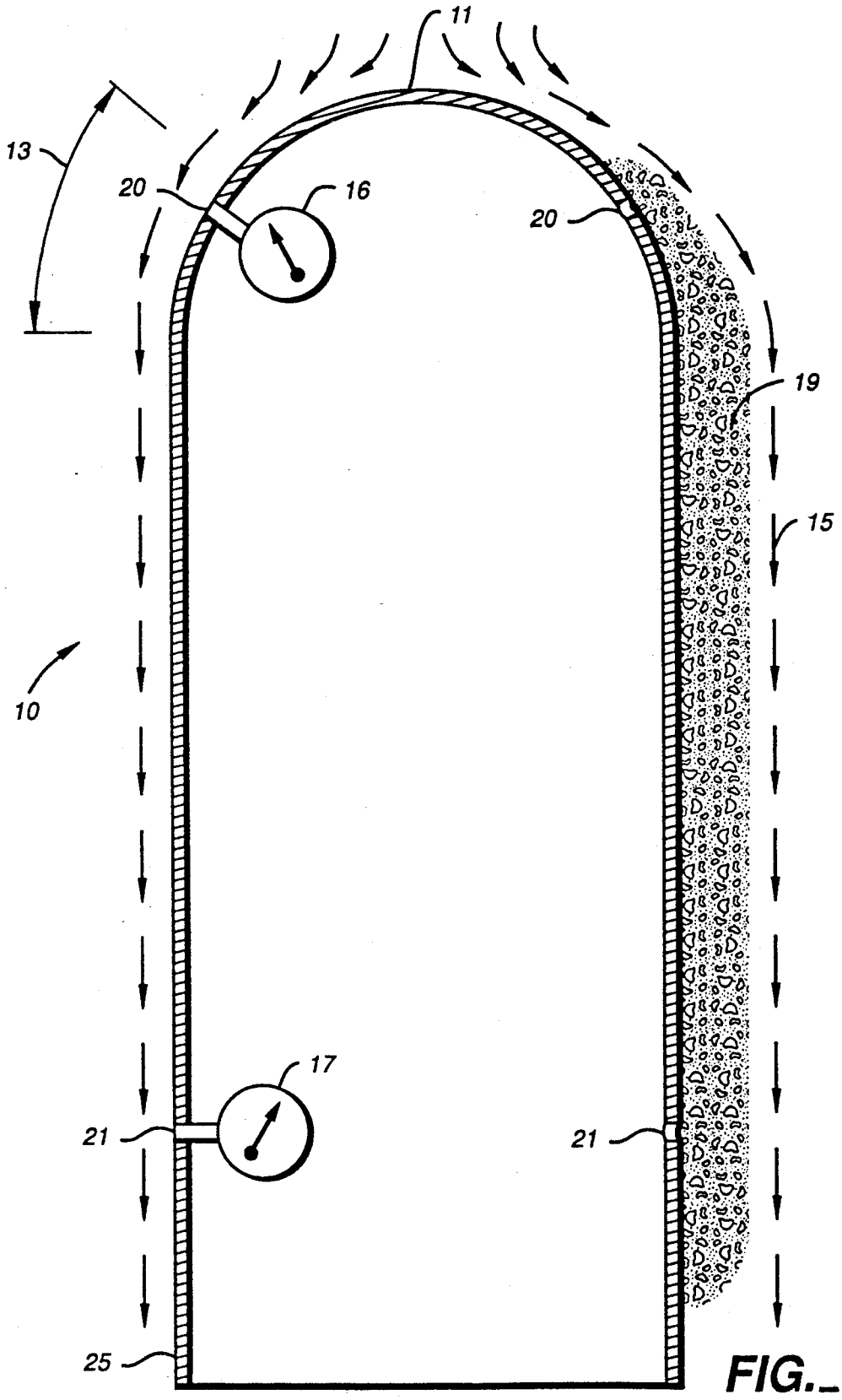
FIG. 8 is a representation of a hollow missile body travelling upward through the water, showing the path of water flowing over the exterior without venting (left side) and with venting (right side).

When a missile is ejected from a submerged submarine launch tube, gas vents from cavities within the interior of the missile through various openings in the missile exterior surface out into the water as the missile travels from deep water to the surface (as a consequence of the gas expanding due to the decreasing surrounding water pressure). FIG. 8 is a representation of a hollow missile 10 travelling upward through the water, showing the relative path of water (represented by arrows 15) flowing over its exterior (i.e., represented as if the missile were stationary and the water were flowing downward over it). The left-hand side shows the path of water with no gas venting; the right-hand side shows the path of water with gas venting (the bubbles 19 represent gas introduced into the water flow). As the missile 10 is traveling underwater, the pressure that the water exerts on the exterior surface of the missile 10 varies over the length of the path from the nose tip 11 to the bottom end 25 of the cylindrical body. Where the water flows in a path that is concave adjacent to the missile surface (as in region 13 at a point mid-way between the tip of the nose and the junction between the nose and the cylindrical body) there will exist a lower pressure than in adjacent regions where the flow is straight (such as along the cylindrical body sides) or convex (such as near the tip of the nose). Such a lower-pressure region is herein defined as a "low relative pressure region." The pressure gauges 16 and 17, inserted into ports 20 and 21 on the left-hand side of missile 10, illustrate the differences in pressure that exist in the usual situation without gas venting. If the port 20 is open as shown on the right-hand side of FIG. 8, gas will flow out from within the missile, thereby increasing the pressure in the local area downstream from port 20 and hence altering the pressure over a portion of the surface of the missile. The result of this pressure distribution alteration is the production of a pitching moment acting on the missile (a counter-clockwise pitching moment for the situation shown in FIG. 8). The present invention exploits the naturally occurring non-uniform pressure distribution by directing venting gas into selected regions that would otherwise be at lower pressure. The layer of gas 19 permits the higher pressure near the aft end of the cylindrical portion of the body to be transmitted upward to the lower pressure region of the nose, thus altering the pressure distribution over a portion of the surface of the missile to produce a pitching moment, thence influencing the trajectory of the missile.

DESCRIPTION OF A FIRST EMBODIMENT

Figure 3:
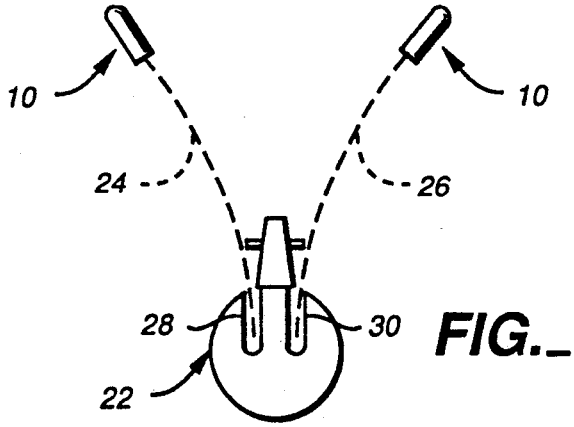
FIG. 3 illustrates the deflected trajectories of two missiles launched from a submarine, as produced by the embodiment of the invention as illustrated in FIGS. 1 and 2.
Figure 1:
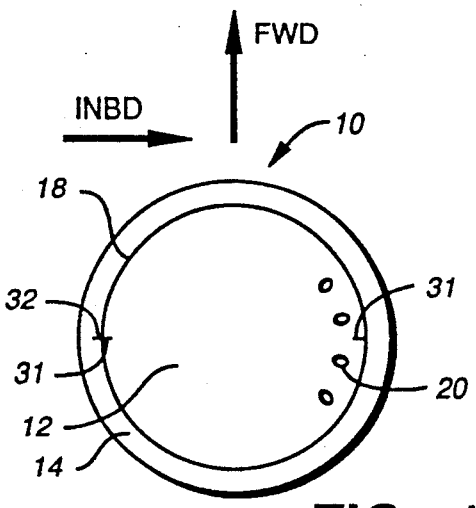
FIG. 1 is a top (i.e., nose-on) view of a missile illustrating a first embodiment of the present invention, configured for the sole purpose of deflecting the path of a submarine-launched missile sideways in order to avoid submarine damage in the event of missile fallback.
Figure 2:
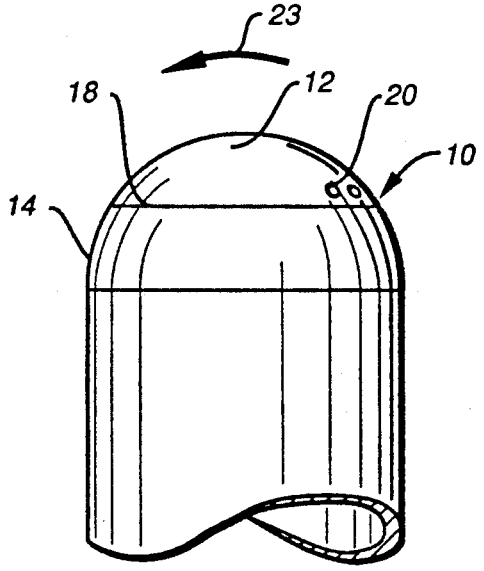
FIG. 2 is a side view of the front portion of the missile shown in FIG. 1.

Referring now to the drawings, FIGS. 1 and 2 illustrate a first embodiment of the present invention in which the gas which normally vents uncontrolled from a missile during underwater travel is used to influence the missile trajectory. FIGS. 1 and 2 illustrate a simple embodiment that is designed to produce an underwater trajectory in which the missile course veers outboard away from the launching submarine 22, as represented in FIG. 3 by left launch trajectory 24 and right launch trajectory 26 (from launch tubes 28 and 30 respectively). The missile 10 has a nose cap 12 and a nose fairing 14 making up the nose of the missile. The region near joint 18 between the nose cap 12 and the nose fairing 14 is provided with gas vent ports 20 designed to emit gas venting from the interior of the missile; to assure maximum gas flow from the vent ports the exterior of the missile 10 should be sealed in other areas. The ports 20 are sized and distributed in a manner chosen to provide the desired amount of deviation from a vertical trajectory.

The nose cap 12 and the nose fairing 14 are designed to position the gas vent ports 20 on the inboard side of the missile 10 for either left or right launches. A suitable design, for example, could incorporate a two-positioning-slots-and-a-pin indexing arrangement, schematically represented in FIG. 1 by lines 31 (two slots) and 32 (one pin) on the nose cap 12 and nose fairing 14 respectively, which would permit the nose cap to be positioned with the proper alignment for either a left tube or right tube launch.

With the gas vent ports 20 located on the inboard side of the missile 10, the gas will vent asymmetrically from the missile's interior and produce a pitching moment in the direction represented by arrow 23 in FIG. 2. An outboard moment and angular rotation will be imparted to the missile 10 such that the trajectory of the missile will carry it away from the region directly over the submarine 22. Thus, in the event of the non-ignition of the first stage rocket motor, the missile 10 will not strike the submarine 22 as it falls back into the water.

DESCRIPTION OF THE PREFERRED EMBODIMENT

Figure 4:
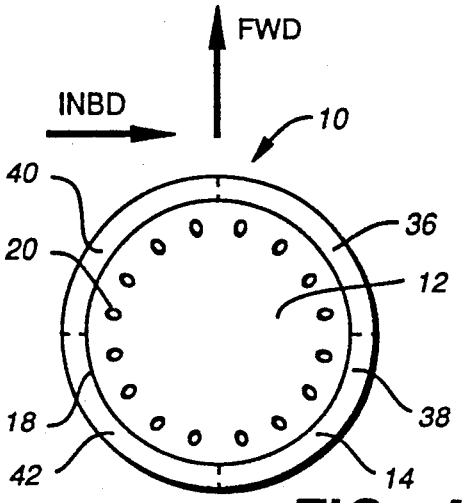
FIG. 4 is a top (i.e., nose-on) view of a missile illustrating a second and the preferred embodiment of the present invention, configured for actively controlling the underwater trajectory of a submarine-launched missile to conform to flight path requirements at various stages of the underwater trajectory.
Figure 5:
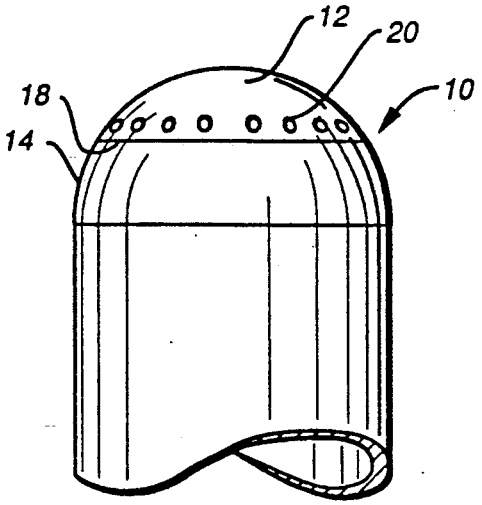
FIG. 5 is a side view of the front portion of the missile shown in FIG. 4.
Figure 6:
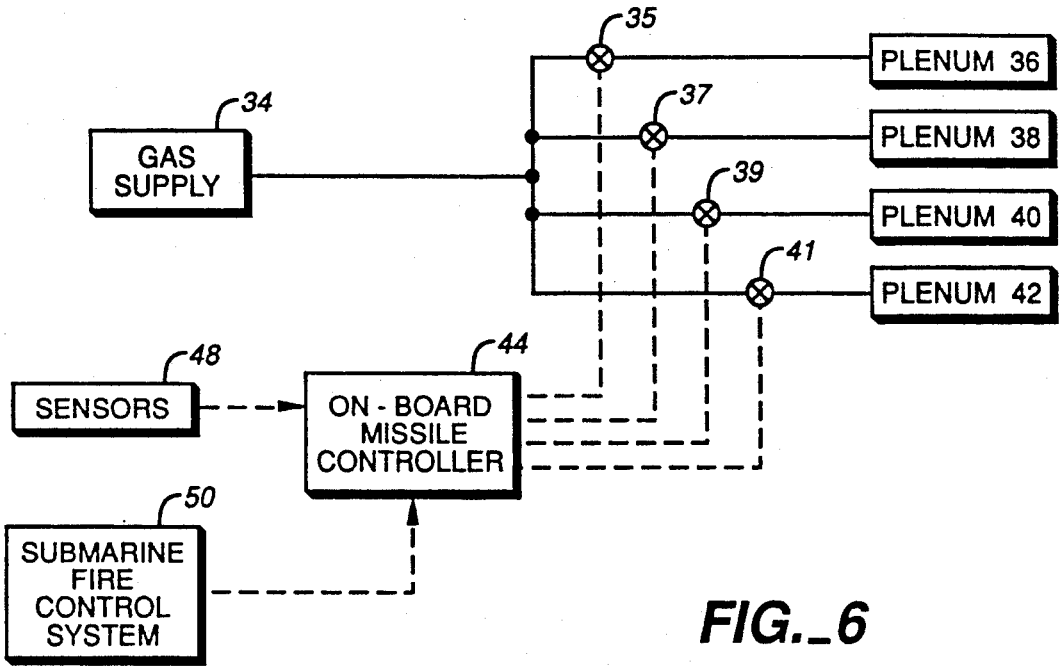
FIG. 6 is a block diagram showing the relationship of devices to actively control the gas venting so as to control the underwater course of the missile.

FIGS. 4 and 5, and the block diagram of FIG. 6, illustrate a second and the preferred embodiment of the present invention, which actively controls the venting of gas from the interior of the missile to control the underwater trajectory of the missile. The missile 10 as shown in FIGS. 4 and 5 has a nose cap 12 and a nose fairing 14 making up the nose of the missile. A gas supply 34 (which could simply be the gas enclosed within the missile, but could also be a gas generator or a gas storage device) provides gas to a plurality of plenums, represented by four plenums 36, 38, 40 and 42, via flow control valves 35, 37, 38 and 40 under the direction of a controller 44. The plenums 36–42 are located in the region of the nose cap to fairing joint 18, and symmetrically located around the circumference of the missile 10. Each plenum 36–42 is connected to a plurality of gas vent ports 20 located near joint 18. Various other arrangement of plenums are possible, but at least three are required to be able orient the axis of the net pitching moment perpendicular to any desired plane containing the flight axis of the missile.

The controller 44 may receive missile inputs (such as attitude, angular rates and accelerations) from multi-axis missile sensors 48, along with commands from the submarine fire control system 50, to control the venting of gas from the various plenums 36–42. The gas flow may be adjusted to conform to requirements at various stages of the underwater trajectory. By venting gas out of plenums 36 and 38 on the inboard side of the missile, for example, the missile may be forced away from the side of the submarine as illustrated in FIG. 3, to avoid damage to the submarine in the event of missile fallback. Alternatively by venting gas from plenums 38 and 42, the missile may be pitched forward to counteract the effects of crossflow between the submarine and the surrounding water.

Figure 7:
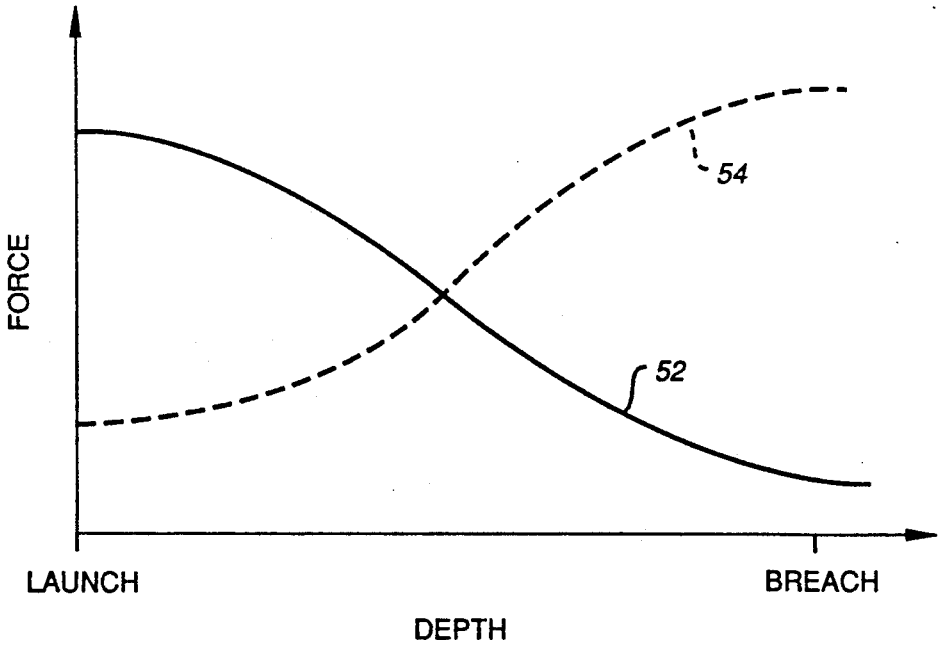
FIG. 7 is a plot illustrating the relative magnitude of the pitching moment required as a function of missile depth, for crossflow cancelling (solid) and for submarine avoidance (dashed).

Curves 52 and 54 of FIG. 7 illustrate the relative magnitude of the pitching moment required as a function of missile depth, for crossflow cancelling and for submarine avoidance, respectively. Thus when it is primarily desired to cancel the effects of submarine-induced crossflow, the moments applied (for example from plenums 38 and 42) to the missile while the missile is leaving the launch tube may be made initially high to avoid the missile striking the tube, then reduced after the missile has left the tube. In the case where submarine avoidance is the primary goal, the moments in the launch tube may be made initially low; when the missile is away from the tube the moments may be increased to facilitate avoidance of the submarine in the event of missile fallback. The moments provided by the plenums 36–42 may be combined to provide both crossflow cancelling and submarine avoidance. The multi-axis sensors 48 may also be used to provide automatic control to counteract vessel-induced or wave-induced effects or to enhance vessel avoidance.

Description of a Third Embodiment

Figure 9:
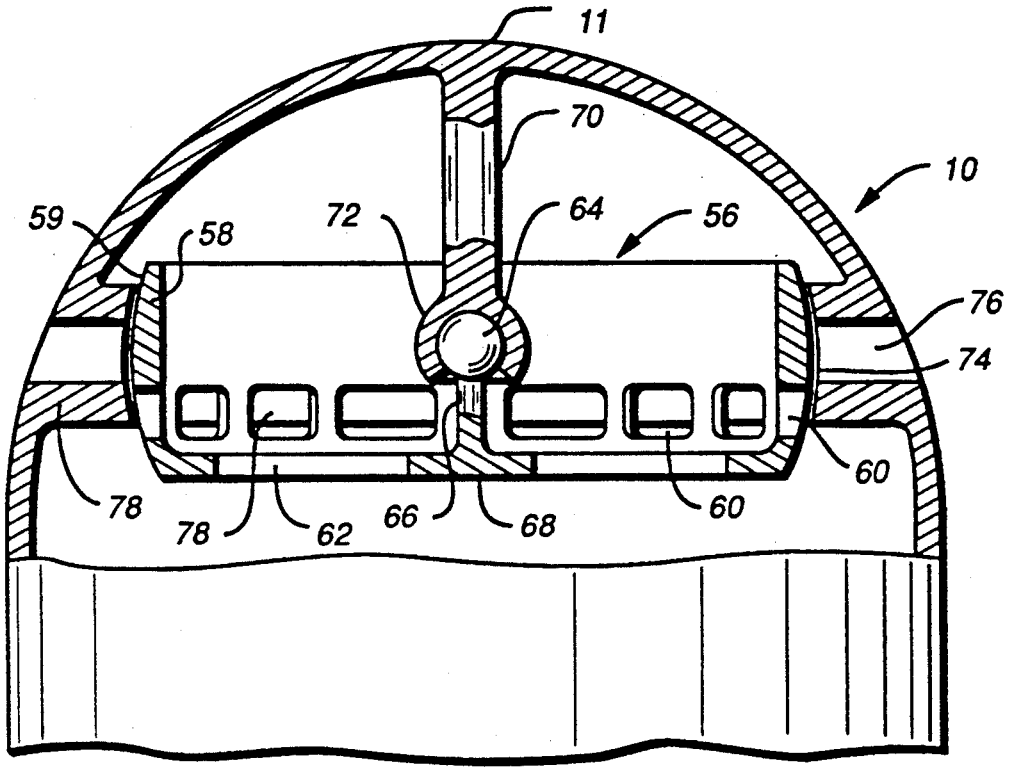
FIG. 9 is a sectional view of the nose portion of a missile, showing a simplified representative apparatus for keeping a missile pointing straight upward as it travels toward the surface by a using a device (such as the pan shown) to uncover ports on the listing side.
Figure 10:
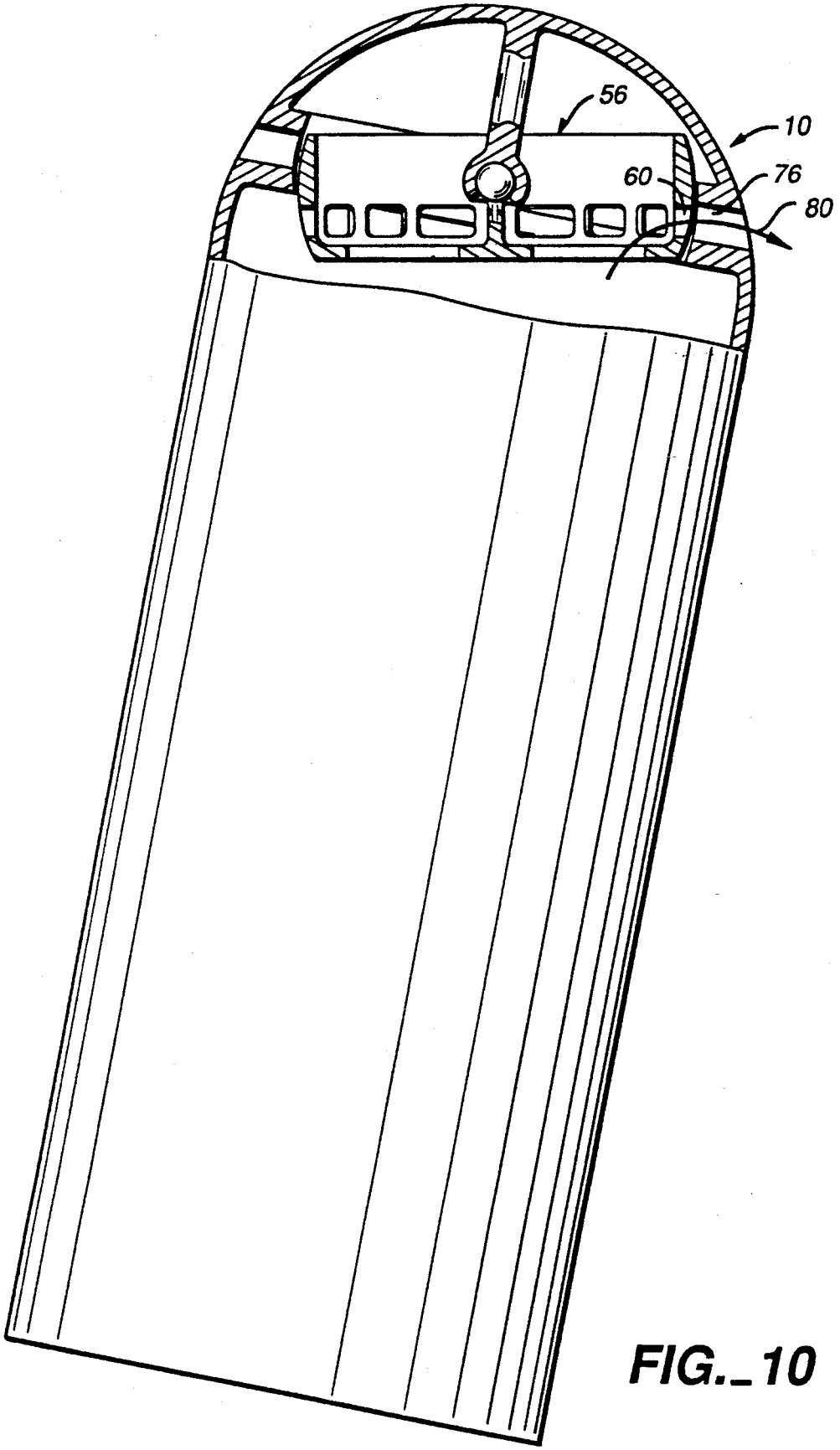
FIG. 10 is a view of a missile utilizing the device shown in FIG. 9, showing the relationship between the pan and the ports when the missile is listing from a vertical position.

FIGS. 9 and 10 represent a third embodiment of the present invention, here utilized for the purpose of simply keeping the missile pointing straight upward during the entire course of underwater travel.

FIG. 9 is a sectional view of the nose portion of a missile 10, showing a simplified representative apparatus for keeping a missile pointed straight up as it travels toward the surface. A spherical socket 72 is suspended downward from the nose tip 11 by rod 70. A pan 56 is suspended from the spherical socket 72 by pedestal 66 which is connected at its upper end to ball 64 and at its lower end to the bottom 68 of pan 56; ball 64 is free to rotate within socket 72. Pan rim 58 has a spherical outer surface 59, having a common center of curvature with ball 64 and with spherical inner surface 74 of ring 78. The bottom 68 of pan 56 is perforated by holes 62 to allow venting gas to communicate from within the interior of missile 10 up through slots 60 in the pan rim 58 and then out through ports 76 in ring 78 when the pan bottom 68 is not perpendicular to the flight axis of the missile 10, as illustrated by arrow 80 in FIG. 10. Pan 56 has a center of gravity that is below the center of socket 72, hence pan 56 will tend to remain in a horizontal position even though missile 10 deviates from a straight vertical attitude (at least for this simplified example—a more complex system could use an automatic control system to keep pan 56 horizontal). In operation a tilt (in any direction) will result in the slots 60 in pan wall 58 being brought into communication with ports 76 through ring 78 on the listing side of the missile 10 (ports 76 are evenly distributed around the circumference of ring 78) as shown in FIG. 10. This results in releasing gas from vent ports 76 on the listing side, generating a self-correcting pitch moment tending to point the missile 10 back toward an upright position.

This invention has been described in detail with reference to certain particular embodiments, but it will be understood by those skilled in the art that variations and modifications can be effected within the spirit and scope of the invention.

That which is claimed is:

1. An apparatus for controlling the underwater trajectory of a hollow missile that has been launched underwater by pressurized gas, said missile having a body including cylindrical sides and a generally rounded nose, said apparatus comprising:

a plurality of vent ports communicating between the interior and exterior of said hollow missile, said vent ports being located on the nose and distributed about the circumference of a circle oriented perpendicular to the body cylindrical sides; and means for controlling venting of gas contained within the hollow missile interior through the vent ports.

2. An apparatus for controlling the underwater trajectory of a hollow missile that has been launched underwater by pressurized gas as recited in claim 1, wherein said means for controlling venting of the contained gas includes:

at least three plenums, each plenum separately fluidly communicating with a corresponding set of vent ports;

one flow control valve per plenum, each valve fluidly communicating between a corresponding plenum and the interior of said hollow missile; and a missile controller operationally connected to each flow control valve.

3. An apparatus for controlling the underwater trajectory of a hollow missile that has been launched underwater by pressurized gas as recited in claim 1, wherein said vent ports are identical in both size and shape, and are equally spaced around said circumference.

4. An apparatus for controlling the underwater trajectory of a hollow missile that has been launched underwater by pressurized gas as recited in claim 3, wherein said means for controlling venting of the contained gas includes means for venting the contained gas from ports on the listing side of a tilting missile responsive to missile deviation from a vertical attitude.

* * * * *